US007159860B2

(12) United States Patent
Sasahara

(10) Patent No.: US 7,159,860 B2
(45) Date of Patent: Jan. 9, 2007

(54) STRIKE DOWN MECHANISM FOR SHEET PROCESSING DEVICE

(75) Inventor: Katsuya Sasahara, Izu (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/008,122

(22) Filed: Dec. 10, 2004

(65) Prior Publication Data

US 2006/0066021 A1 Mar. 30, 2006

(30) Foreign Application Priority Data

Sep. 28, 2004 (JP) ..... 2004-281784

(51) Int. Cl.
*B65H 37/04* (2006.01)

(52) U.S. Cl. ..... 270/58.14; 270/58.18; 270/58.08; 270/58.11; 399/410

(58) Field of Classification Search ..... 270/58.08, 270/58.11, 58.12, 58.14, 58.16, 58.18; 271/189, 271/190, 191, 192; 399/410
See application file for complete search history.

(56) References Cited

U.S. PATENT DOCUMENTS

| | | | | |
|---|---|---|---|---|
| 4,473,425 | A | 9/1984 | Baughman et al. | |
| 4,611,741 | A | 9/1986 | Wilson | |
| 4,794,859 | A | 1/1989 | Huseby et al. | |
| 4,898,374 | A | 2/1990 | Vermaat | |
| 5,098,074 | A | 3/1992 | Mandel et al. | |
| 5,112,034 | A | 5/1992 | Uto et al. | |
| 5,282,611 | A | 2/1994 | Ueda et al. | |
| 5,285,249 | A | 2/1994 | Mahoney | |
| 5,289,251 | A | 2/1994 | Mandel et al. | |
| 5,435,544 | A | 7/1995 | Mandel | |
| 5,451,037 | A | 9/1995 | Lundstrom | |
| 5,628,502 | A | 5/1997 | Amarakoon | |
| 5,676,517 | A | 10/1997 | Lotz | |
| 5,709,376 | A | 1/1998 | Ushirogata | |
| 5,934,140 | A | 8/1999 | Jackson et al. | |
| 5,961,274 | A | 10/1999 | Bors | |
| 5,971,384 | A | 10/1999 | Asao | |
| 6,065,747 | A | 5/2000 | Khovaylo et al. | |
| 6,092,948 | A | 7/2000 | Altfather | |
| 6,231,039 | B1 * | 5/2001 | Chung | 270/58.01 |
| 6,330,999 | B1 * | 12/2001 | Coombs et al. | 270/58.18 |
| 6,336,630 | B1 | 1/2002 | Holtman et al. | |
| 6,354,059 | B1 | 3/2002 | Yoshie et al. | |
| 6,450,934 | B1 * | 9/2002 | Coombs | 493/383 |

(Continued)

FOREIGN PATENT DOCUMENTS

JP 62008965 A * 1/1987

(Continued)

OTHER PUBLICATIONS

U.S. Appl. No. 11/008,124, filed Dec. 10, 2004, Terao et al.

(Continued)

*Primary Examiner*—Patrick Mackey
(74) *Attorney, Agent, or Firm*—Foley & Lardner LLP

(57) ABSTRACT

A waiting tray is provided at some midpoint of a conveying path, and a sheet is caused to be in a waiting state when a post-process is required. Before performing the post-process, a processing tray receives the sheet conveyed from the waiting tray and the sheet conveyed from a conveying path without passing through the waiting tray. The waiting tray is formed by waiting tray parts which are arranged at a predetermined interval, and a strike-down mechanism is operated. Therefore, a bundle of paper loaded on the waiting tray is caused to fall down on the process tray.

5 Claims, 11 Drawing Sheets

U.S. PATENT DOCUMENTS

| | | | | |
|---|---|---|---|---|
| 6,641,129 | B1 | 11/2003 | Ogita et al. | |
| 6,671,492 | B1 | 12/2003 | Mimura et al. | |
| 6,698,744 | B1 | 3/2004 | Yamada et al. | |
| 6,712,349 | B1 | 3/2004 | Watanabe | |
| 6,722,646 | B1 * | 4/2004 | Sekiyama et al. | 270/58.09 |
| 6,733,006 | B1 | 5/2004 | Kobayashi et al. | |
| 6,819,906 | B1 | 11/2004 | Herrmann et al. | |
| 6,824,128 | B1 | 11/2004 | Nagata et al. | |
| 6,910,686 | B1 | 6/2005 | Awano | |
| 6,928,259 | B1 | 8/2005 | Sakuma | |
| 2002/0047233 | A1 | 4/2002 | Coombs et al. | |
| 2002/0163119 | A1 | 11/2002 | Kawata | |
| 2004/0113348 | A1 | 6/2004 | Awano | |
| 2004/0126163 | A1 | 7/2004 | Asami et al. | |
| 2005/0000336 | A1 | 1/2005 | Hattori et al. | |

FOREIGN PATENT DOCUMENTS

| | | | |
|---|---|---|---|
| JP | 4-312894 | A | 11/1992 |
| JP | 6-99070 | B2 | 7/1994 |
| JP | 8-217321 | A | 8/1996 |
| JP | 2001-089009 | A | 4/2001 |
| JP | 2003-081517 | A | 3/2003 |

OTHER PUBLICATIONS

U.S. Appl. No. 11/008,131, filed Dec. 10, 2004, Terao et al.
U.S. Appl. No. 11/008,132, filed Dec. 10, 2004, Terao et al.
U.S. Appl. No. 11/008,142, filed Dec. 10, 2004, Terao et al.
U.S. Appl. No. 11/008,145, filed Dec. 10, 2004, Terao et al.
U.S. Appl. No. 11/008,147, filed Dec. 10, 2004, Terao et al.
U.S. Appl. No. 11/008,148, filed Dec. 10, 2004, Terao et al.
U.S. Appl. No. 11/008,199, filed Dec. 10, 2004, Terao et al.
U.S. Appl. No. 11/008,222, filed Dec. 10, 2004, Terao et al.
U.S. Appl. No. 11/008,224, filed Dec. 10, 2004, Terao et al.
U.S. Appl. No. 11/008,230, filed Dec. 10, 2004, Terao et al.
U.S. Appl. No. 11/008,247, filed Dec. 10, 2004, Terao et al.
U.S. Appl. No. 11/008,248, filed Dec. 10, 2004, Terao et al.
U.S. Appl. No. 11/008,251, filed Dec. 10, 2004, Terao et al.
U.S. Appl. No. 11/008,257, filed Dec. 10, 2004, Terao et al.
U.S. Appl. No. 11/008,271, filed Dec. 10, 2004, Terao et al.
U.S. Appl. No. 11/008,290, filed Dec. 10, 2004, Terao et al.
U.S. Appl. No. 11/008,294, filed Dec. 10, 2004, Terao et al.
U.S. Appl. No. 11/008,295, filed Dec. 10, 2004, Terao et al.
U.S. Appl. No. 11/008,299, filed Dec. 10, 2004, Terao et al.
U.S. Appl. No. 11/008,349, filed Dec. 10, 2004, Terao et al.
U.S. Appl. No. 11/008,350, filed Dec. 10, 2004, Terao et al.
U.S. Appl. No. 11/008,381, filed Dec. 10, 2004, Terao et al.
U.S. Appl. No. 11/008,392, filed Dec. 10, 2004, Terao et al.
U.S. Appl. No. 11/008,567, filed Dec. 10, 2004, Terao et al.
Y. Terao, et al., Notice of Allowance and Fee(s) Due, U.S. Appl. No. 11/008,124, Sep. 30, 2005, 9 pages.
Y. Terao et al., Notice of Allowance and Fee(s) Due, U.S. Appl. No. 11/008,132, Oct. 06, 2005, 9 pages.
U.S. Appl. No. 11/085,226, filed Mar. 22, 2005, Terao et al.
U.S. Appl. No. 11/085,227, filed Mar. 22, 2005, Terao et al.
U.S. Appl. No. 11/085,240, filed Mar. 22, 2005, Terao et al.
U.S. Appl. No. 11/085,241, filed Mar. 22, 2005, Terao et al.
U.S. Appl. No. 11/085,242, filed Mar. 22, 2005, Terao et al.
U.S. Appl. No. 11/085,243, filed Mar. 22, 2005, Terao et al.
U.S. Appl. No. 11/085,244, filed Mar. 22, 2005, Terao et al.
U.S. Appl. No. 11/085,247, filed Mar. 22, 2005, Terao et al.
U.S. Appl. No. 11/085,248, filed Mar. 22, 2005, Terao et al.
U.S. Appl. No. 11/085,250, filed Mar. 22, 2005, Terao et al.
U.S. Appl. No. 11/085,251, filed Mar. 22, 2005, Iizuka et al.
U.S. Appl. No. 11/085,256, filed Mar. 22, 2005, Terao et al.
U.S. Appl. No. 11/085,257, filed Mar. 22, 2005, Terao et al.
U.S. Appl. No. 11/085,264, filed Mar. 22, 2005, Terao et al.
U.S. Appl. No. 11/085,625, filed Mar. 22, 2005, Terao et al.
Y. Terao et al., U.S. PTO Office Action, U.S. Appl. No. 11/008,131, Feb. 23, 2006, 9 pgs.
Y. Terao et al., U.S. PTO Office Action, U.S. Appl. No. 11/008,222, Feb. 24, 2006, 12 pgs.
Y. Terao et al., U.S. PTO Office Action, U.S. Appl. No. 11/008,230, Feb. 24, 2006, 11 pgs.
Y. Terao et al., U.S. PTO Office Action, U.S. Appl. No. 11/085,226, Jan. 13, 2006, 9 pgs.
Y. Terao et al., U.S. PTO Office Action, U.S. Appl. No. 11/085,227, Feb. 09, 2006, 9 pgs.
Y. Terao et al., U.S. PTO Office Action, U.S. Appl. No. 11/085,240, Jan. 26, 2006, 8 pgs.
Y. Terao et al., U.S. PTO Office Action, U.S. Appl. No. 11/085,241, Feb. 09, 2006, 9 pgs.
Y. Terao et al., U.S. PTO Office Action, U.S. Appl. No. 11/085,243, Jan. 26, 2006, 6 pgs.
Y. Terao et al., U.S. PTO Office Action, U.S. Appl. No. 11/085,244, Feb. 09, 2006, 7 pgs.
Y. Terao et al., U.S. PTO Notice of Allowance, U.S. Appl. No. 11/085,243, Jan. 05, 2006, with attached Notice of Withdrawal from Issue dated Jan. 10, 2006, 10 pgs.
Y. Terao et al., U.S. PTO Office Action, U.S. Appl. No. 11/008,392, Dec. 14, 2005, 9 pages.
Y. Terao et al., U.S. PTO Office, U.S. Appl. No. 11/008,294, Dec. 13, 2005, 9 pages.
Y. Terao et al., U.S. PTO Office, U.S. Appl. No. 11/008,299, Dec. 13, 2005, 9 pages.
Y. Terao et al., U.S. PTO Office, U.S. Appl. No. 11/008,349, Dec. 13, 2005, 9 pages.
Y. Terao et al., U.S. PTO Office, U.S. Appl. No. 11/008,567, Dec. 13, 2005, 9 pages.
Y. Terao et al., U.S. PTO Office Action, U.S. Appl. No. 11/008,224, Nov. 21, 2005, 10 pages.
Y. Terao et al., U.S. PTO Office Action, U.S. Appl. No. 11/008,257, Nov. 30, 2005, 9 pages.
Y. Terao et al., U.S. PTO Office Action, U.S. Appl. No. 11/008,271, Nov. 30, 2005, 9 pages.
Y. Terao et al., U.S. PTO Office Action, U.S. Appl. No. 11/008,290, Nov. 30, 2005, 9 pages.
Y. Terao et al., U.S. PTO Office Action, U.S. Appl. No. 11/008,148, Jan. 11, 2006, 12 pages.
Y. Terao et al., U.S. PTO Office Action, U.S. Appl. No. 11/008,251, Jan. 13, 2006, 11pages.
Y. Terao et al., U.S. PTO Office Action, U.S. Appl. No. 11/008,350, Jan. 26, 2006, 12 pages.
Y. Terao et al., U.S. PTO Office Action, U.S. Appl. No. 11/008,295, Jan. 05, 2006, 11 pages.
Y. Terao et al., Notice of Allowance and Fee(s) Due, U.S. Appl. No. 11/008,199, Apr. 20, 2006, 15 pages.
Y. Terao et al., Notice of Allowance and Fee(s) Due, U.S. Appl. No. 11/008,247, May 01, 2006, 16 pages.
Y. Terao et al., Notice of Allowance and Fee(s) Due, U.S. Appl. No. 11/008,349, May 02, 2005, 9 pages.
Y. Terao et al., U.S PTO Office Action, U.S. Appl. No. 11/008,224, Apr. 21, 2006, 12 pages.
Y. Terao et al., U.S PTO Office Action, U.S. Appl. No. 11/008,257, Apr. 28, 2006, 13 pages.
Y. Terao et al., U.S PTO Office Action, U.S. Appl. No. 11/008,271, Apr. 25, 2006, 14 pages.
Y. Terao et al., U.S PTO Office Action, U.S. Appl. No. 11/008,294, May 05, 2006, 13 pages.
Y. Terao et al., U.S PTO Office Action, U.S. Appl. No. 11/008,299, May. 05, 2006, 12 pages.
Y. Terao et al., U.S PTO Office Action, U.S. Appl. No. 11/008,392, Apr. 26, 2006, 10 pages.
Y. Terao et al., Notice of Allowance and Fee(s) Due, U.S. Appl. No. 11/008,148, Jun. 26, 2006, 10 pages.
Y. Terao et al., Notice of Allowance and Fee(s) Due, U.S. Appl. No. 11/008,251, Jun. 26, 2006, 10 pages.
Y. Terao et al., Notice of Allowance and Fee(s) Due, U.S. Appl. No. 11/085,241, Jun. 26, 2006, 10 pages.
Y. Terao et al., Notice of Allowance and Fee(s) Due, U.S. Appl. No. 11/085,243, Jun. 26, 2006, 10 pages.
Y. Terao et al., U.S PTO Office Action, U.S. Appl. No. 11/008,295, Jun. 23, 2006, 14 pgs.

Y. Terao et al., U.S. PTO Office Action, U.S. Appl. No. 11/008,132, Jun. 09, 2006, with attached Notice of Withdrawl from Issue dated May 30, 2006, 11 pgs.
Y. Terao et al., Notice of Allowance and Fee(s) Due, Serial No. 11/085,244, Jul. 13, 2006, 10 pages.
Y. Terao et al., U.S. PTO Office Action, Serial No. 11/008,145, Jun. 30, 2006, 6 pgs.
Y. Terao et al., U.S. PTO Office Action, Serial No. 11/008,147, Jul. 07, 2006, 4 pgs.
Y. Terao et al., U.S. PTO Office Action, Serial No. 11/008,290, Jul. 21, 2006, 15 pgs.
Y. Terao et al., U.S. PTO Office Action, Serial No. 11/008,350, Jul. 6, 2006, 12 pgs.
Y. Terao et al., U.S. PTO Office Action, Serial No. 11/085,226, Jul. 20, 2006, 12 pages.
Y. Terao et al., U.S. PTO Office Action, Serial No. 11/085,227, Aug. 11, 2006, 15 pages.
Y. Terao et al., U.S. PTO Office Action, Serial No. 11/085,240, Aug. 2, 2006, 15 pages.
Y. Terao et al., U.S. PTO Office Action, Serial No. 11/085,247, Jul. 13, 2006, 14 pgs.
Y. Terao et al., U.S. PTO Office Action, Serial No. 11/085,248, Jul. 5, 2006, 15 pgs.
Y. Terao et al., U.S. PTO Office Action, Serial No. 11/085,256, Jul. 13, 2006, 13 pgs.
Y. Terao et al., U.S. PTO Office Action, Serial No. 11/085,625, Jul. 28, 2006, 13 pgs.
Y. Terao et al., Notice of Allowance and Fee(s) Due, Serial No. 11/008,295, Sep. 21, 2006, 7 pages.
Y. Terao et al., Notice of Allowance and Fee(s) Due, Serial No. 11/008,350, Sep. 21, 2006, 7 pages.
Y. Terao et al., Notice of Allowance and Fee(s) Due, Serial No. 11/008,392, Sep. 15, 2006, 10 pages.
Y. Terao et al., U.S. PTO Office Action, Serial No. 11/008,381, Aug. 23, 2006, 17 pages.
Y. Terao et al., U.S. PTO Office Action, Serial No. 11/008,567, Aug. 21, 2006, 14 pages.
Y. Terao, et al., Notice of Allowance and Fee(s) Due, Serial No. 11/008,222, Aug. 31, 2006, 12 pgs.
Y. Terao, et al., Notice of Allowance and Fee(s) Due, Serial No. 11/008,299, Sep. 6, 2006, 9 pgs.

* cited by examiner

STRIKE DOWN MECHANISM FOR SHEET PROCESSING DEVICE

CROSS-REFERENCE TO RELATED APPLICATIONS

This application is based upon and claims the benefit of priority from prior Japanese Patent Application No. 2004-281784, filed Sep. 28, 2004, the entire contents of which are incorporated herein by reference.

BACKGROUND OF THE INVENTION

1. Field of the Invention

The present invention relates to a sheet post-process apparatus, such as a finisher, which is designed for installation at the outlet side of a multi-function periperal (MFP).

2. Description of the Related Art

An apparatus called "finisher" is known, which receives printed sheets supplied from the MFP and staples them together. In the finisher, the sheets supplied from the MFP are sequentially conveyed to a tray and stapled by a stapler, forming a bundle of sheets. The bundle of sheets is ejected from the apparatus onto a storage tray.

Jpn. Pat. Appln. KOKAI Publication No. 6-99070 discloses a finisher. This finisher performs a post-process on sheets. In the post-process, a stapler staples sheets. To process the sheets at the same rate as the MFP processes them, it is necessary to reduce the speed at which sheets are conveyed in the finisher. The finisher therefore has a long sheet-conveying path.

In Jpn. Pat. Appln. KOKOKU Publication No. 6-99070, because two sheet paths of a sort path and a non-sort path exist, the number of mechanical parts such as a roller is increased by the sort path.

A paper post-process apparatus, which is arranged to retract a jogger stage for jogging the sheets of paper in order to move a bundle of paper onto the storage tray when the process of stapling sheets together with the stapler is finished, is well known (Jpn. Pat. Appln. KOKAI Publication No. 8-217321).

BRIEF SUMMARY OF THE INVENTION

An object of the invention is to provide the sheet post-process apparatus which can decrease the number of mechanical parts such as the roller to achieve miniaturization and cost reduction of the apparatus.

According to an aspect of the invention, there is provided a sheet post-process apparatus comprising: a plurality of rollers configured to receive and convey a sheet conveyed from an MFP main body; a standby tray which is provided at some midpoint of a conveying path, and is configured to cause the sheet conveyed from the roller to be in a waiting state when a post-process is required, the waiting tray including a pair of standby tray parts arranged at a predetermined interval in a transverse direction orthogonal to a sheet conveying direction; a processing tray configured to receive the sheet conveyed from the waiting tray and the sheet conveyed from a conveying path without passing through the waiting tray before performing the post-process; a strike-down mechanism configured to strike the sheet loaded in the waiting tray down on the processing tray; an alignment mechanism configured to align the sheets on the processing tray to form a bundle of sheets; a post-process mechanism configured to perform the post-process of the bundle of sheets aligned on the processing tray; a sheet conveying unit configured to convey the bundle of sheets to which the post-process has been performed from the processing tray; and a storage tray configured to load the conveyed bundle of sheets thereon.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment of this invention will be described, with reference to the accompanying drawings.

Figure 1:
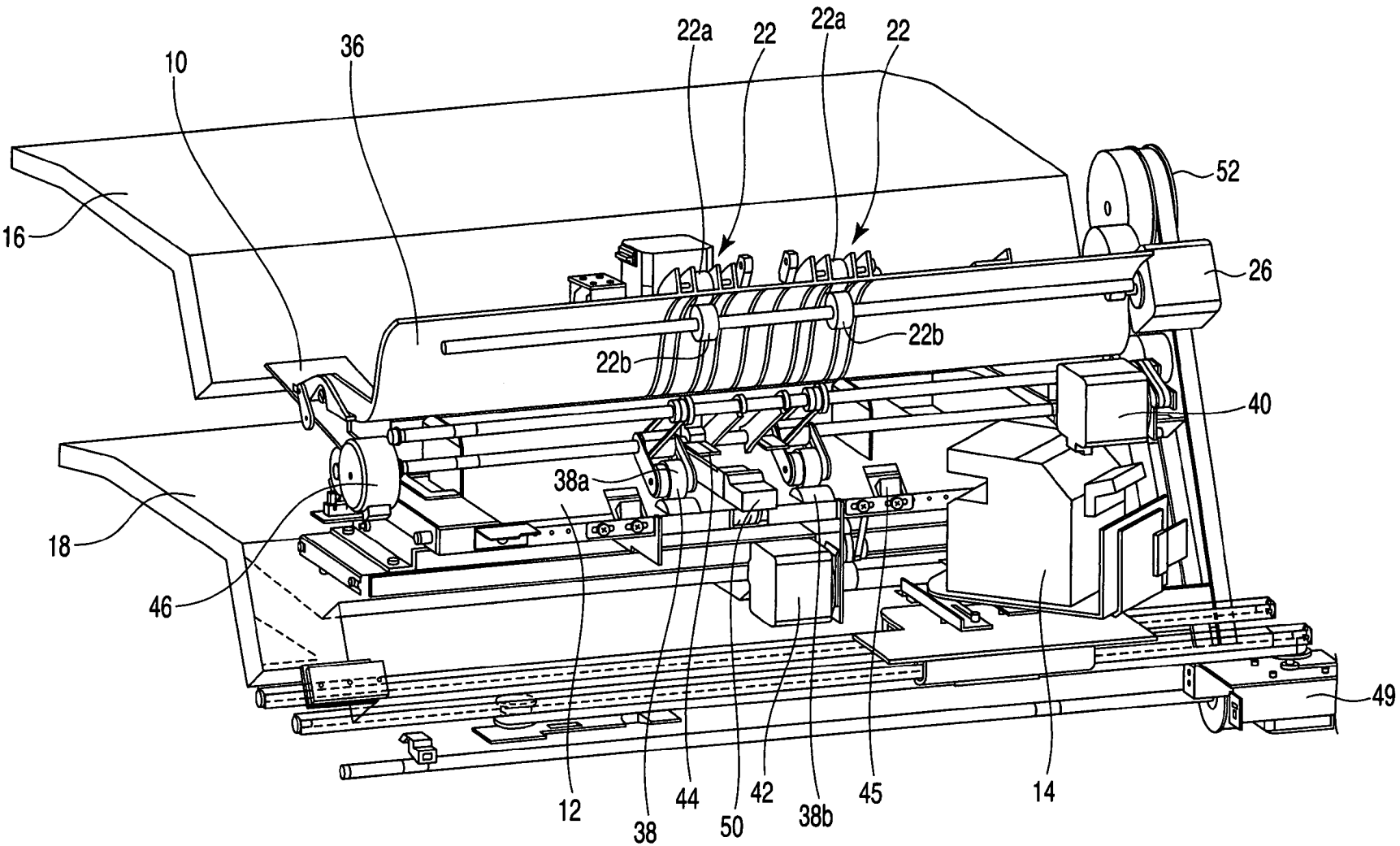
FIG. 1 is a perspective view of a post-process apparatus according to the invention.
Figure 2:
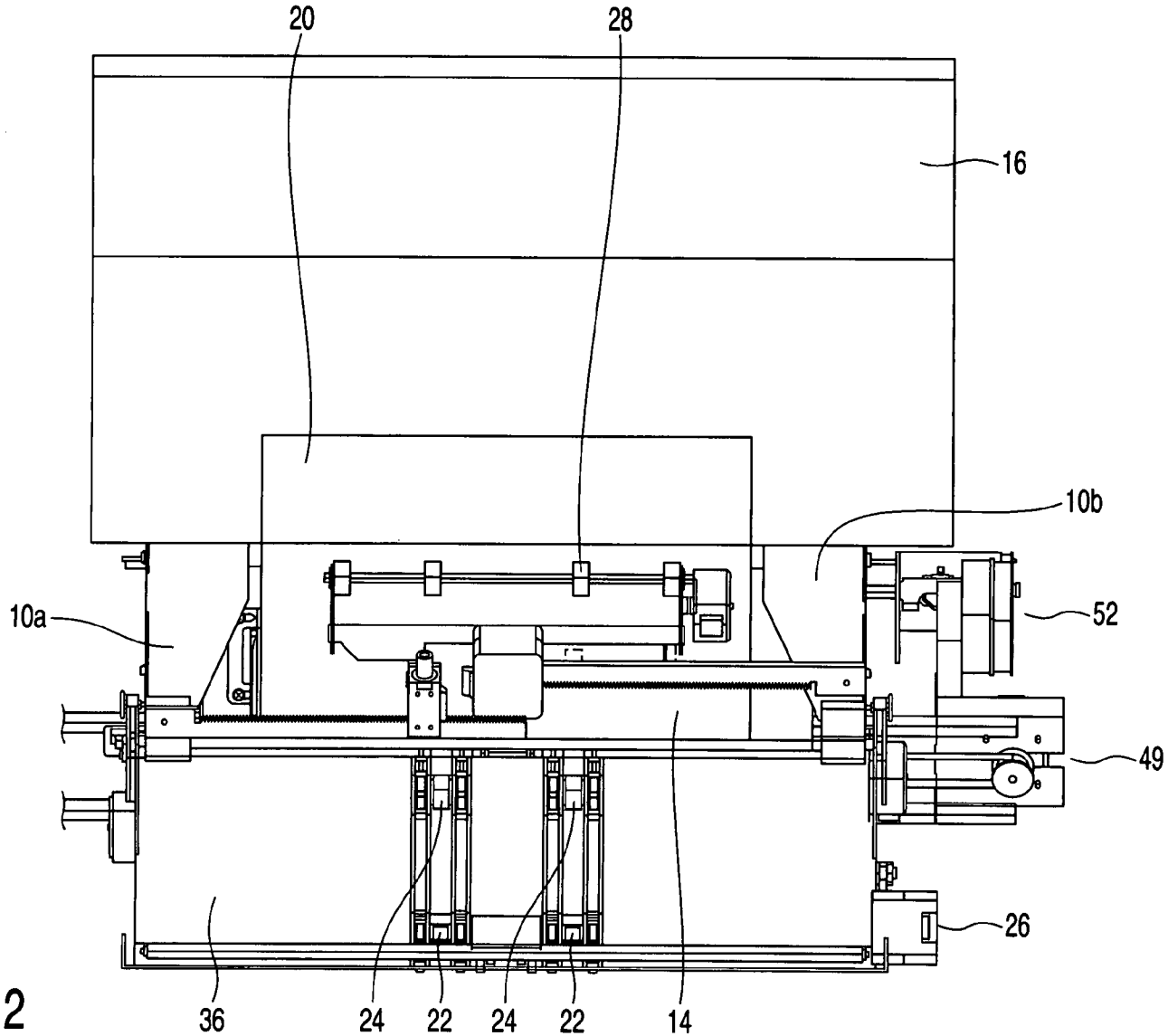
FIG. 2 is a top view of the post-process apparatus according to the invention.

FIG. 1 is a perspective view of a sheet post-process apparatus according to this invention. FIG. 2 is a top view of the post-process apparatus. As FIG. 1 shows, the post-process apparatus comprises a waiting tray 10, a processing tray 12, a stapler 14, a first storage tray 16, and a second storage tray 18.

The sheet post-process apparatus further comprises a pair of input rollers 22, a pair of sheet-feeding rollers 24, and an input-roller motor 26. The input rollers 22 receive a sheet 20 supplied from an MFP 1 (see FIG. 7) and convey the sheet 20 to the sheet-feeding rollers 24. The sheet-feeding rollers 24 convey the sheet 20 to the waiting tray 10. The input-roller motor 26 drives the input rollers 22.

One of the input rollers 22 is an upper input roller 22*a*, and the other input roller 22 is a lower input roller 22*b*. Likewise, one of the sheet-feeding rollers 24 is an upper sheet-feeding roller, and the other sheet-feeding roller 24 is a lower sheet-feeding roller.

Figure 15:
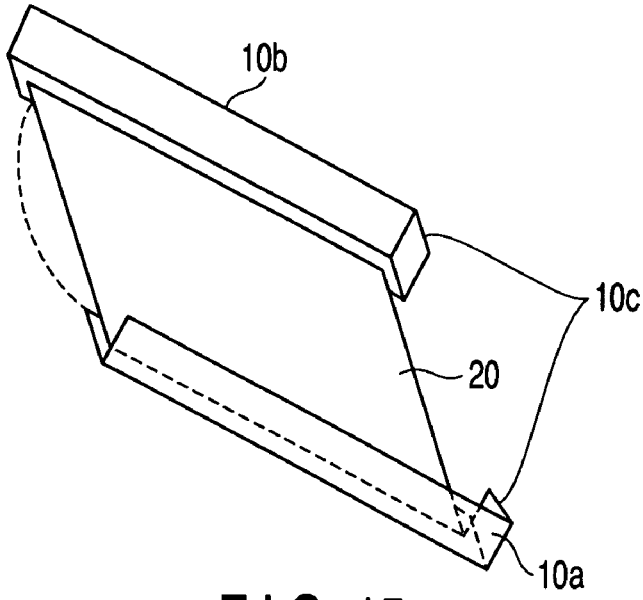
FIG. 15 is a view for explaining the waiting tray in the post-process apparatus according to the embodiment of the invention.

The waiting tray 10 includes a pair of waiting tray parts 10*a* and 10*b* having an L-shaped cross section, which are arranged at a predetermined interval as shown in FIG. 15. The paper 20 is loaded between the waiting tray parts 10*a* and 10*b*. Namely, as shown in FIG. 15, the paper 20 is loaded so that transverse sides of the paper 20 get snagged on the waiting tray parts 10*a* and 10*b*. A hold portion 10*c* for holding the lowermost portion of the paper loaded on the waiting tray 10 is provided because the waiting tray 10 is obliquely arranged.

Widths in the paper 20 conveying directions of the waiting tray 10 and the processing tray 12 are smaller than the width in the conveying direction of the paper 20. When the paper falls down on the processing tray 12, the paper 20 is loaded across the processing tray 12 and the storage tray (shown in FIG. 2).

Thus, the width along the conveying direction of the paper in the post-process apparatus can be decreased.

Figure 14:
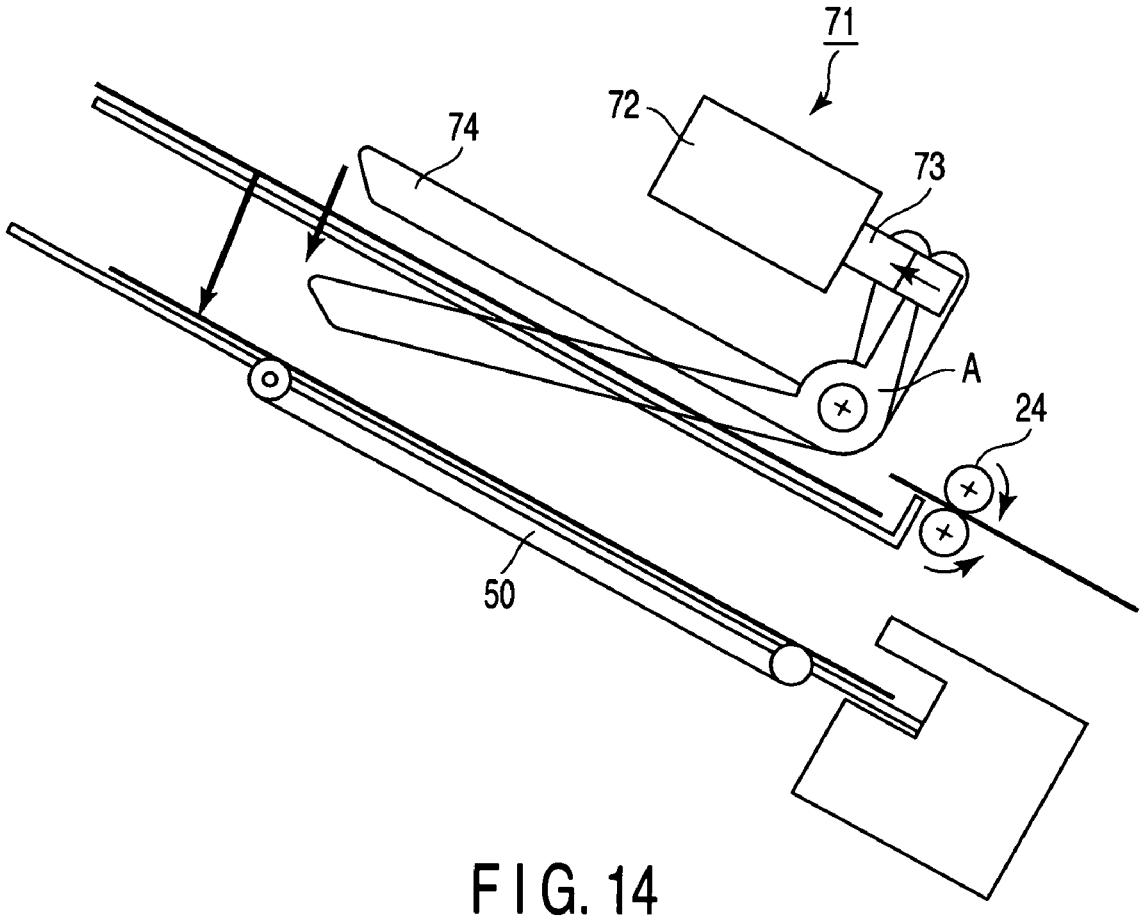
FIG. 14 is a view for explaining a strike-down mechanism in the post-process apparatus according to the embodiment of the invention.

As shown in FIG. 14, a strike-down mechanism 71 for striking the paper 20 down on the processing tray 12 above an intermediate position between the waiting tray parts 10*a* and 10*b*. The strike-down mechanism 71 includes a solenoid 72, a plunger 73 which is sucked and ejected in accordance with magnetic excitation or non-excitation of the solenoid 72, and an L-shaped strike-down member 74 which is supported while freely rotated about a point A attached to one end of the plunger 73. The later-mentioned controller 85 controls passage of electric current through the solenoid 72.

Figure 16:
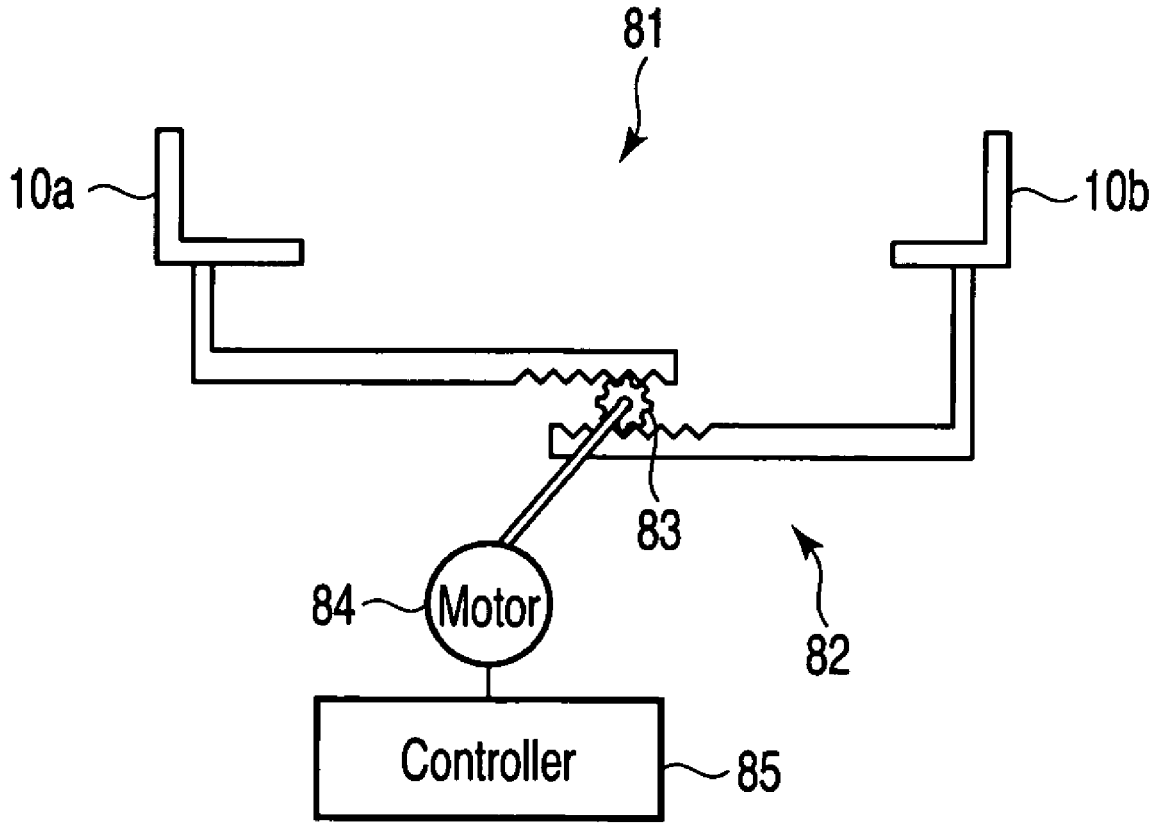
FIG. 16 is a view for explaining a paper width adjustment mechanism in the post-process apparatus according to the embodiment of the invention.

As shown in FIG. 16, a paper width adjustment mechanism 81 for adjusting the interval between the waiting tray parts 10*a* and 10*b* in accordance with the width of the paper 20 is provided in the waiting tray parts 10*a* and 10*b*. The paper width adjustment mechanism 81 includes a rack and pinion mechanism 82 which is coupled to the waiting tray parts 10*a* and 10*b*, a stepping motor 84 which controls rotation of a pinion gear 83, and the controller 85 which controls the rotation of the stepping motor 84.

Figure 3:
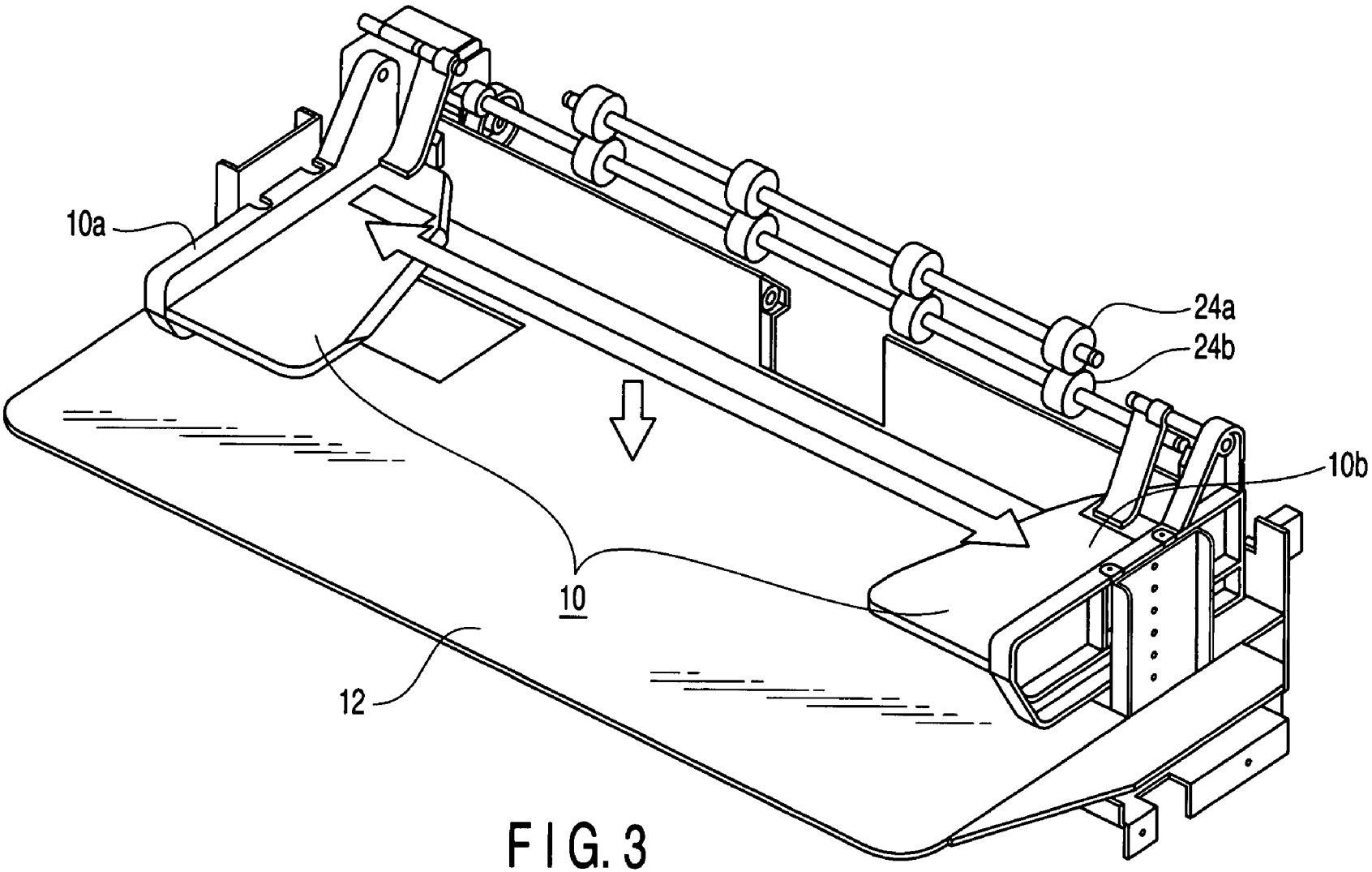
FIG. 3 is a perspective view illustrating how the waiting tray of the post-process apparatus performs its function.

As shown in FIG. 3, when a predetermined number of sheets of paper are stacked in the waiting tray 10, the plunger 73 is sucked in an arrow direction of FIG. 14 by magnetically exciting the plunger 73 with the solenoid 72, which rotates the strike-down member 74 in the arrow direction. As a result, a central portion of the paper 20 loaded on the waiting tray 10 is subject to downward force by the strike-down member 74 and the paper 20 is bent as shown by a broken line in FIG. 15 to fall down on the processing tray 12 by a self weight. The operation is referred to as active drop.

The sheet post-process apparatus has a paper guide 36, which guides sheets from the MFP 1 to the waiting tray 10 and thence to the processing tray 12. The paper guide 36 has a paper-pass ceiling.

Figure 4:
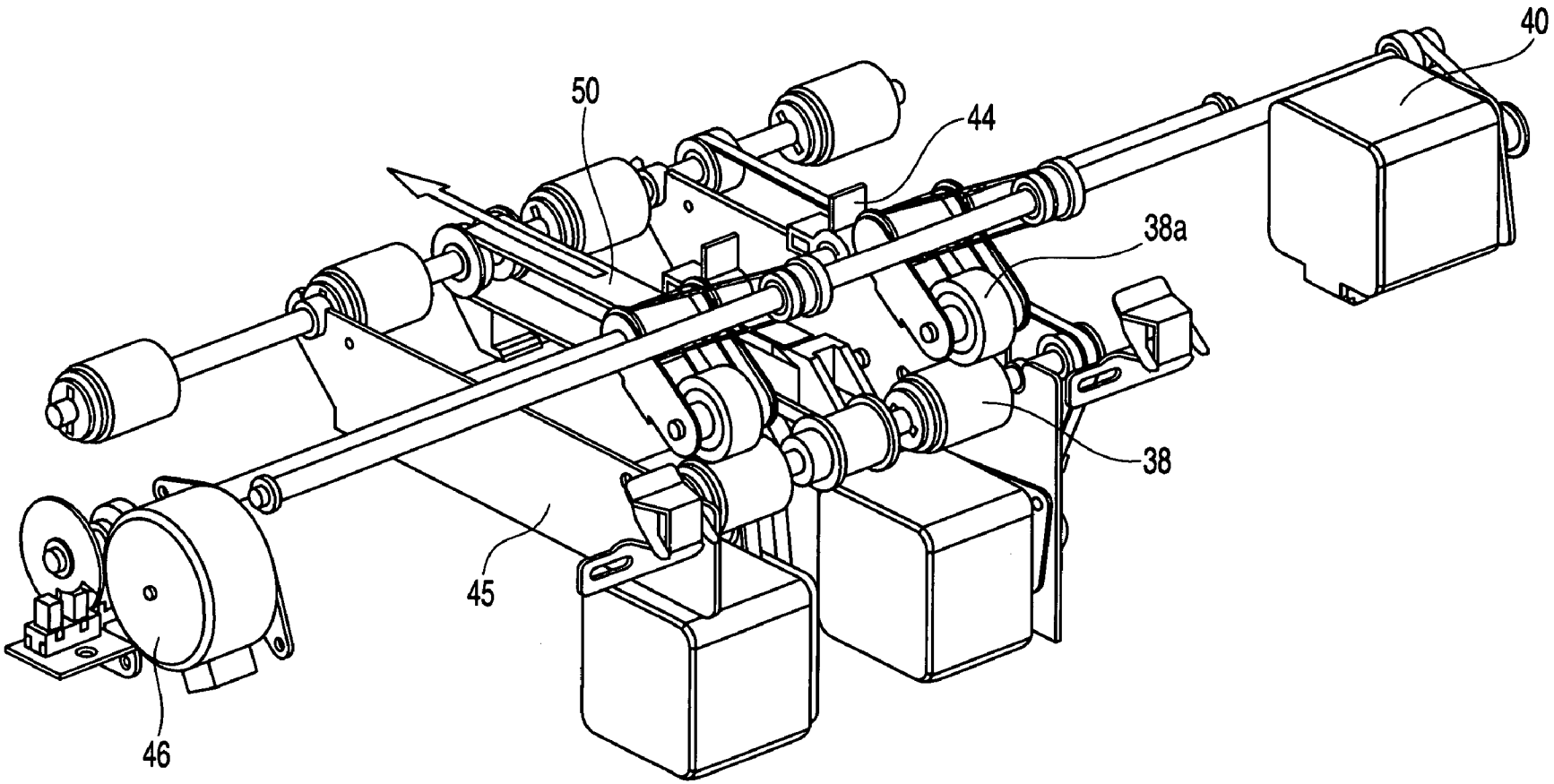
FIG. 4 is a perspective view depicting the sheet-bundle conveying mechanism provided in the post-process apparatus, and explaining how sheets are aligned at longitudinal edges in the post-process apparatus.

In the processing tray 12, the sheets are aligned at the longitudinal edges and the transverse edges. The sheets are aligned at their longitudinal edges by a longitudinal-alignment mechanism 38 as is illustrated in FIG. 4. More precisely, an upper longitudinal-alignment motor 40 drives the upper longitudinal-alignment rollers 38*a* of the mechanism 38, and a lower longitudinal-alignment motor 42 drives the lower longitudinal-alignment rollers 38*b* of the mechanism 38. Driven by the motors 40 and 42, the rollers 38*a* and 38*b* move the sheets until one longitudinal edge of every sheet abuts on a stopper 45. Paddles 44 are provided to facilitate the longitudinal alignment. A paddle motor 46 drives the paddles 44.

Figure 5:
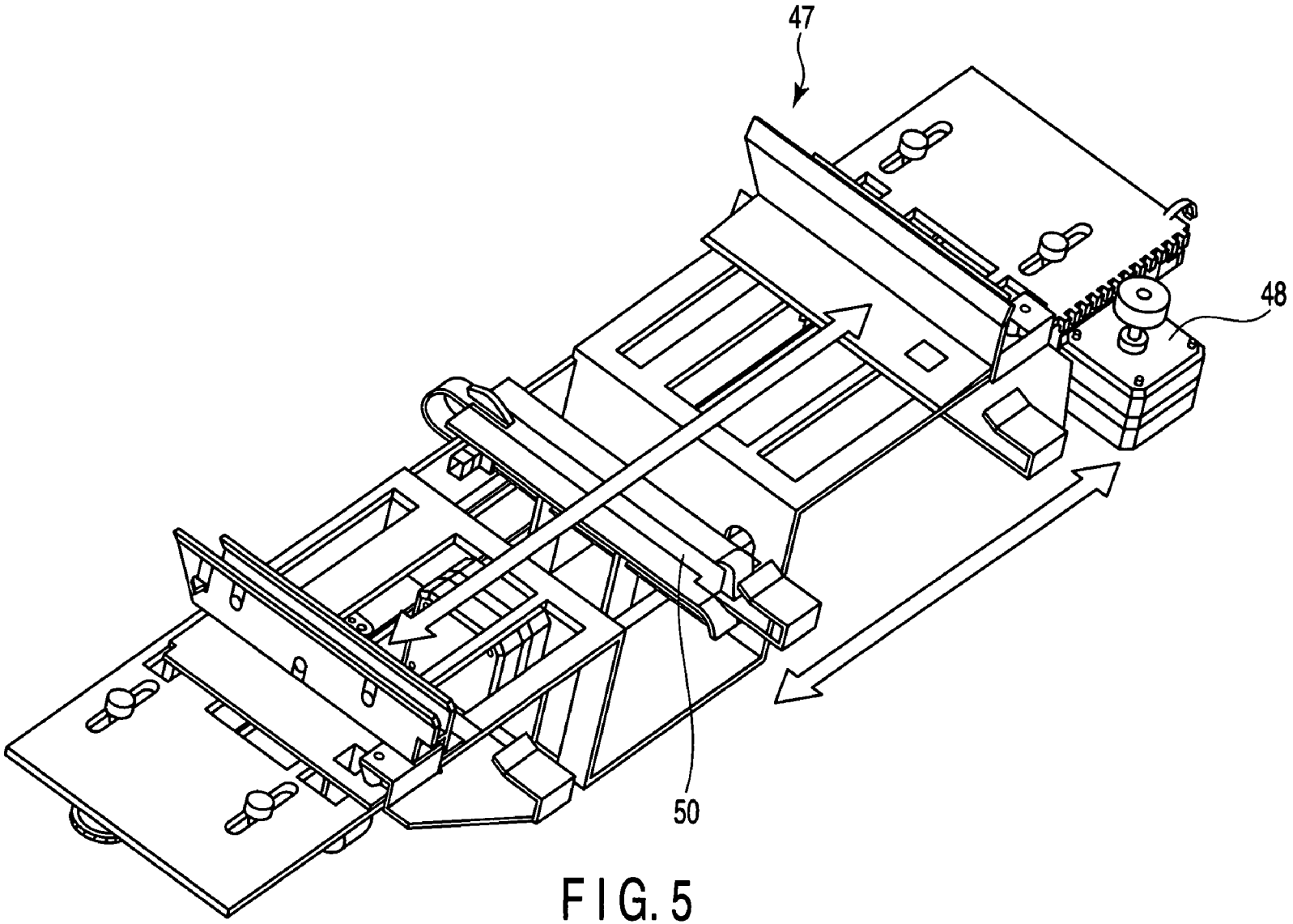
FIG. 5 is a perspective view showing the mechanism for aligning sheets at their transverse edges.

The sheets are aligned at their transverse edges, too, as is illustrated in FIG. 5. More specifically, the transverse alignment is performed by a transverse-alignment mechanism 47 and a transverse-alignment motor 48.

Figure 6:
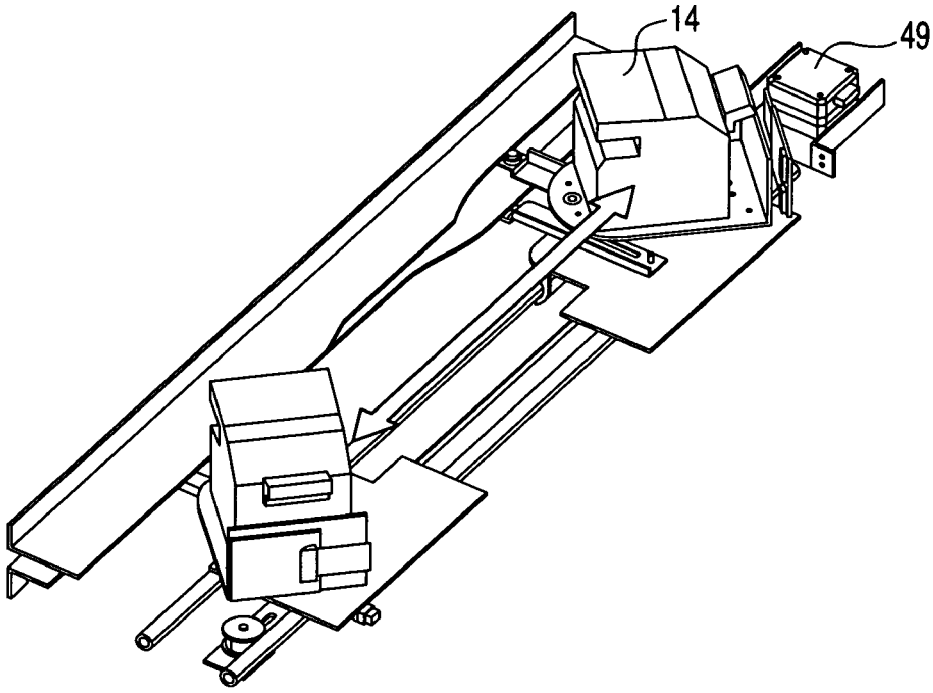
FIG. 6 is a perspective view illustrating how the stapler provided in the post-process apparatus performs its function.

When the number of sheets thus aligned in the processing tray 12 reaches the prescribed value, the stapler 14 starts operating. The stapler 14 is positioned as depicted in FIG. 6 and controlled by a stapler-driving unit 49.

Controlled by the unit 49, the stapler 14 staples the sheets together, forming a bundle of sheets. As shown in FIG. 4, a transport mechanism 50 transports the bundle of sheets to the first storage tray 16. Either the first storage tray 16 or the second storage tray 18 is selected when a storage-tray driving unit 52 moves the tray 16 or 18 to a predetermined upper position.

How the post-process apparatus according to this invention operates will be explained with reference to FIGS. 7 to 16.

Figure 7:
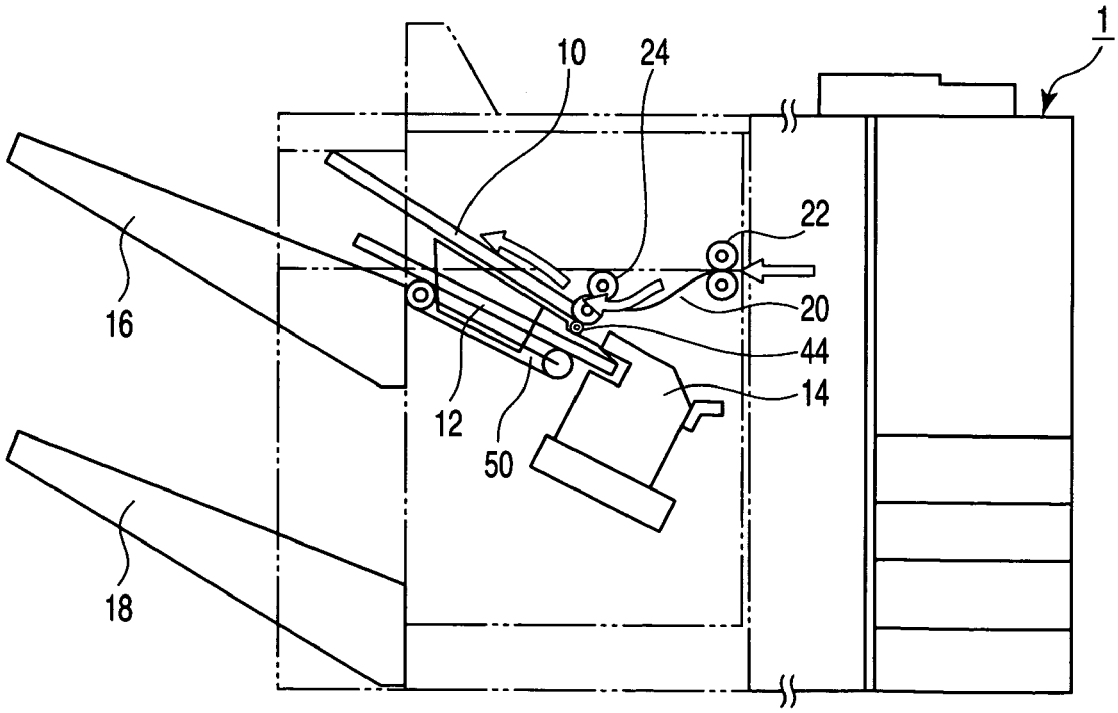
FIG. 7 is a sectional view of the post-process apparatus, showing how the first sheet moves from the input rollers to the sheet-feeding roller.

As FIG. 7 shows, a sheet 20 conveyed from the MFP 1 is moved from the input rollers 22 to the sheet-feeding rollers 24, in the direction of the arrow.

Figure 8:
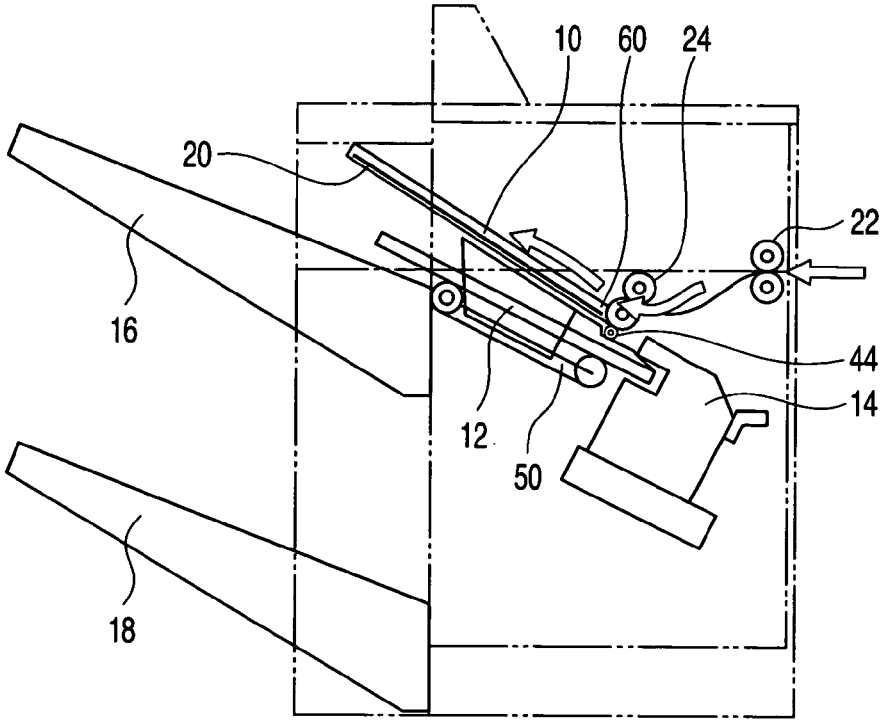
FIG. 8 is a sectional view of the apparatus, explaining how the first sheet moves from the sheet-feeding rollers to the waiting tray.

As is illustrated in FIG. 8, the sheet 20, or the first sheet, is placed on the waiting tray 10. Then, the waiting-tray rollers 28 move down, in the direction of the arrow, aligning the trailing edge of the first sheet 20 at the rear (i.e., upstream) end 60 of the waiting tray 10.

Figure 9:
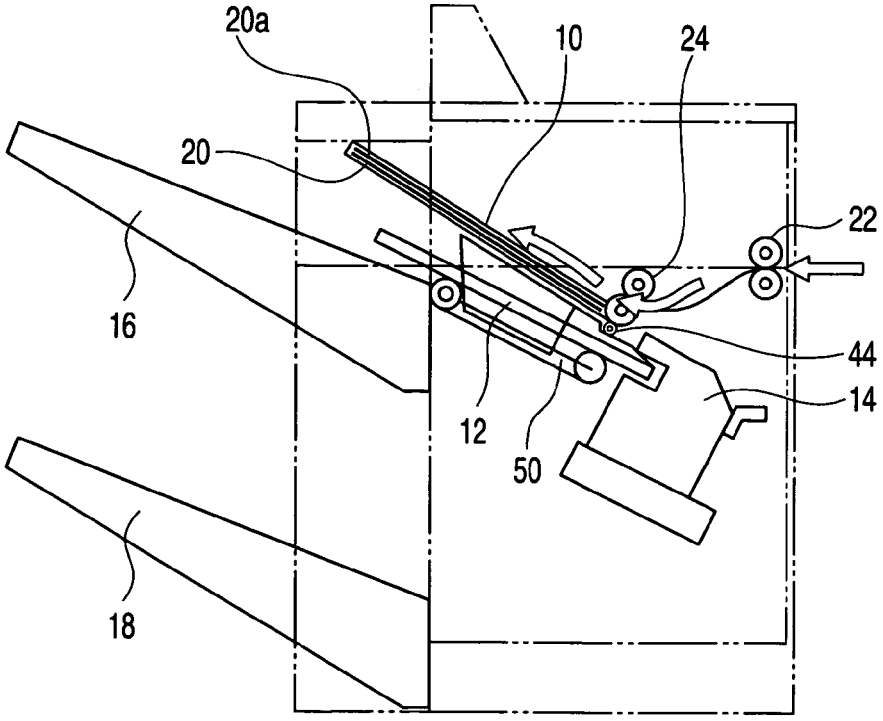
FIG. 9 is a sectional view of the apparatus, explaining how the second sheet moves from the sheet-feeding rollers to the waiting tray.
Figure 10:
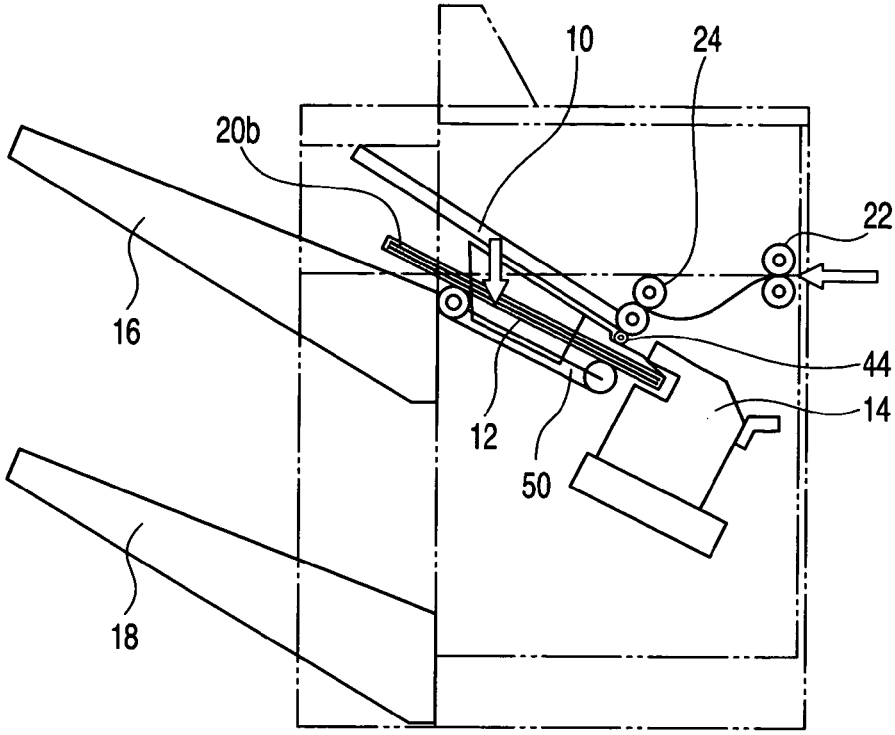
FIG. 10 is a view for explaining the operation of active drop in the post-process apparatus according to the embodiment of the invention.

Then, as shown in FIG. 9, a second sheet of paper 20*a* is conveyed to the waiting tray 10, and the position of the paper 20*a* is aligned by the self weight with reference to the rear end 60 of the waiting tray 10. Thus, a stack of paper 20*b* including the two sheets of paper 20 and 20*a* are formed in the waiting tray 10.

The solenoid 72 is magnetically excited to suck the plunger 73 in the arrow direction of FIG. 14, which rotates the strike-down member 74 in the arrow direction. As a result, the central portion of the stack of paper 20*b* loaded on the waiting tray 10 is subject to the downward force by the strike-down member 74 and the stack of paper 20*b* is bent as shown by the broken line in FIG. 15 to fall down on the processing tray 12 by the self weight. The stack of paper 20*b* is supplied to the processing tray 12 by the active drop.

Figure 11:
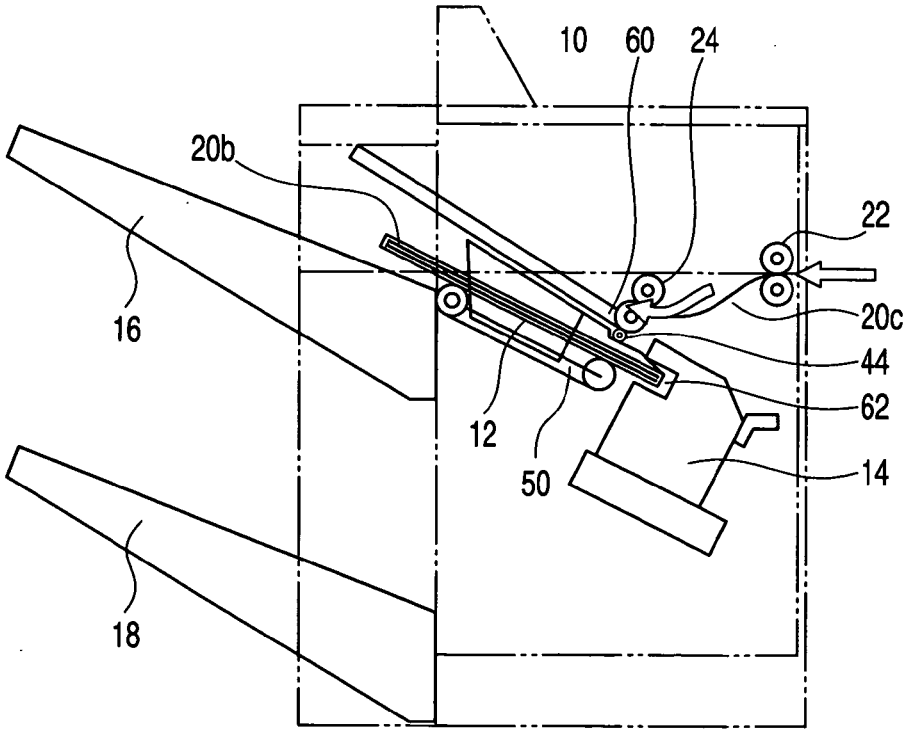
FIG. 11 is a sectional view of the apparatus, explaining how the third sheet is conveyed.

From a third sheet of paper, when the interval between the waiting tray parts 10*a* and 10*b* is widened larger than the width of the paper 20, as shown in FIG. 11, paper 20*c* is directly supplied from the paper feed roller 24 to the processing tray 12 without passing through the waiting tray 10, and the paper 20*c* is loaded on the bundle of paper 20*b* of the two sheets of paper to form a bundle of paper 21. At this point, the longitudinal-alignment mechanism 38 and the transverse-alignment mechanism 47 function so as to perform the alignment of the bundle of paper 21 in the longitudinal and transverse directions.

It is desired that the waiting tray 10 and the processing tray 12 be inclined, having their upstream ends at a lower position than their downstream ends. In other words, they should be so positioned that their rear ends 60 and 62 lie at the lowest position. If the trays 10 and 12 are so inclined, the sheets 20 are aligned, due to gravity, at the rear end 60 of the waiting tray 10, and the bundle 20*b* can be aligned, due to gravity, at the rear end and 62 of the processing tray 12.

Figure 12:
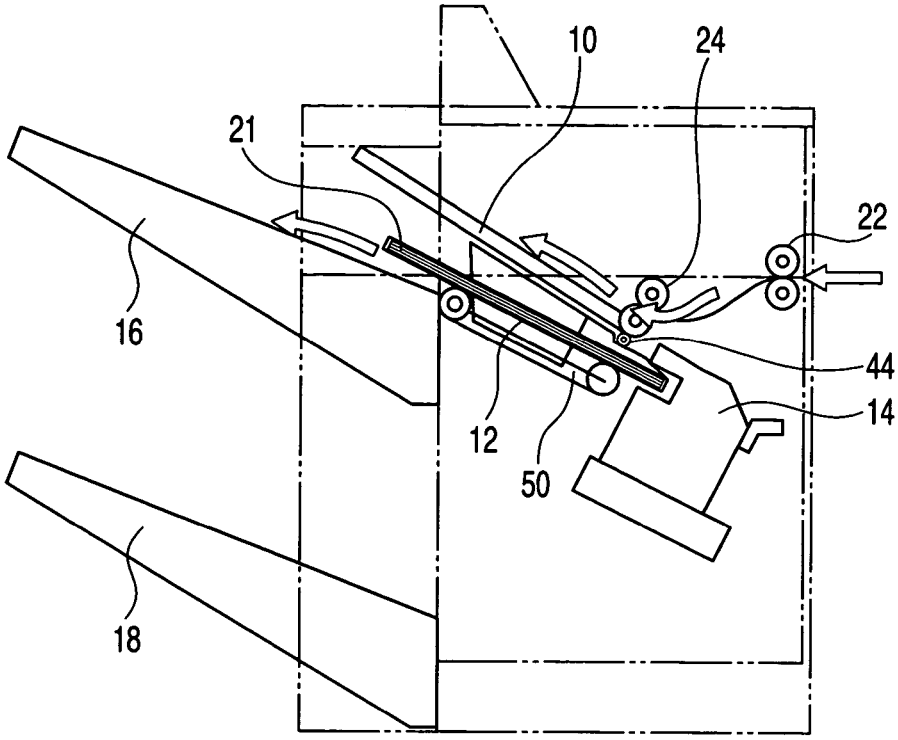
FIG. 12 is a sectional view of the apparatus, illustrating how the stapler operates.
Figure 13:
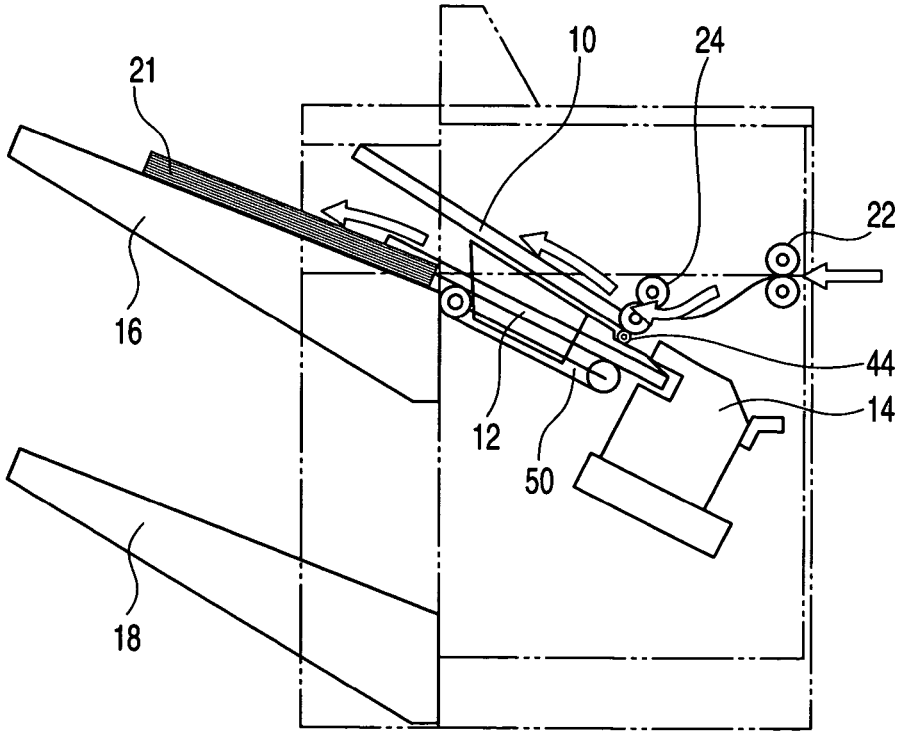
FIG. 13 is a sectional view of the apparatus, explaining how a bundle of sheets moves between the processing tray and the storage tray.

As FIG. 12 shows, the stapler 14 staples the bundle 21 of sheets. Then, the transport mechanism 50 transports the bundle 21 to the storage tray 16 as illustrated in FIG. 13. Thus, the post-process ends.

When the post-process is not required (non-sort), the interval between the waiting tray parts 10*a* and 10*b* is widened larger than the width of the paper 20, and the bundle of paper is directly discharged from the waiting tray 10 to the storage tray 16 through the processing tray 12.

In accordance with the embodiment, the paper 20 is discharged through the same paper path in both the sort process in which the post-process is performed and the non-sort process in which the post-process is not required, so that the miniaturization and the cost reduction of the apparatus can be achieved by decreasing the number of mechanical parts such as the roller.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A sheet post-process apparatus, comprising:

a plurality of rollers configured to receive and convey sheets conveyed from an MFP main body;

a waiting tray which is provided at some midpoint of a conveying path, and is configured to cause a sheet conveyed from the rollers to be in a waiting state when a post-process is required, the waiting tray including a pair of waiting tray parts arranged at a predetermined interval in a transverse direction orthogonal to a sheet conveying direction;

an adjustment mechanism for adjusting the predetermined interval between the pair of waiting tray parts in accordance with a width of the sheet, the predetermined interval being set to a first width smaller than a width of the sheet orthogonal to the sheet conveying direction for loading the sheet being in the waiting state and to a second width larger than the width of the sheet;

a processing tray configured to receive the sheet conveyed from the waiting tray and a sheet conveyed from the rollers without staying at the waiting tray having the pair of waiting tray parts set to the second width before performing the post-process;

a strike-down mechanism provided above the waiting tray and configured to strike the sheet loaded in the waiting tray down on the processing tray, the strike-down mechanism comprising:

a strike-down member for giving a downward force at a center portion of the sheet to make the sheet bent and fall down to the processing tray by a self weight of the sheet;

a solenoid; and a plunger which is sucked and ejected in accordance with magnetic excitation and non-excitation of the solenoid, wherein the strike-down member is supported at one end of the plunger while freely rotated;

an alignment mechanism configured to align sheets on the processing tray to form a bundle of sheets;

a post-process mechanism configured to perform the post-process of the bundle of sheets aligned on the processing tray;

a sheet conveying unit configured to convey the bundle of sheets to which the post-process has been performed from the processing tray; and a storage tray configured to load the conveyed bundle of sheets thereon.

2. A sheet post-process apparatus according to claim 1, wherein the waiting tray and the processing tray are obliquely arranged.

3. A sheet post-process apparatus according to claim 1, wherein the alignment mechanism has a longitudinal alignment mechanism and a transverse mechanism.

4. A sheet post-process apparatus according to claim 1, wherein widths in the sheet conveying directions of the waiting tray and the processing tray are smaller than the width in the conveying direction of the sheet.

5. A sheet post-process apparatus according to claim 1, wherein the sheet is loaded across the processing tray and the storage tray when the sheet falls down on the processing tray.

* * * * *